US009601233B1

(12) United States Patent
Kithuka et al.

(10) Patent No.: US 9,601,233 B1
(45) Date of Patent: Mar. 21, 2017

(54) PLENUM RATED TWISTED PAIR COMMUNICATION CABLES

(71) Applicant: Superior Essex International LP, Atlanta, GA (US)

(72) Inventors: Jones M. Kithuka, Great Bend, KS (US); Thibaut Oscar Lanoe, Kennesaw, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 14/724,103

(22) Filed: May 28, 2015

(51) Int. Cl.
*H01B 3/44* (2006.01)
*H01B 11/08* (2006.01)
*H01B 7/295* (2006.01)

(52) U.S. Cl.
CPC ..... *H01B 3/441* (2013.01); *H01B 7/295* (2013.01); *H01B 11/08* (2013.01)

(58) Field of Classification Search
CPC ..... H01B 7/02; H01B 7/295; H01B 114/02; H01B 11/04; H01B 11/06; H01B 11/002; H01B 11/005; H01B 11/1008
USPC ..... 174/36, 110 R, 113 R, 120 R, 121 R
See application file for complete search history.

(56) References Cited

U.S. PATENT DOCUMENTS 3,894,172 A * 7/1975 Jachimowicz ..... H01B 11/04 174/103
5,493,071 A * 2/1996 Newmoyer ..... H01B 7/295 174/110 FC
5,514,837 A * 5/1996 Kenny ..... C08L 23/10 174/110 FC
5,767,441 A * 6/1998 Brorein ..... H01B 11/002 174/27
5,770,820 A * 6/1998 Nelson ..... C08K 5/0066 174/113 R
6,096,977 A * 8/2000 Beggs ..... H01B 11/005 174/113 R
7,375,284 B2 * 5/2008 Stutzman ..... H01B 11/06 174/110 R
8,704,094 B1 * 4/2014 Gebs ..... H01B 11/02 174/110 PM
2006/0048961 A1 * 3/2006 Pfeiler ..... H01B 11/1008 174/36
2006/0169478 A1 * 8/2006 Clark ..... H01B 11/04 174/113 C
2007/0193769 A1 * 8/2007 Clark ..... H01B 11/06 174/113 R
2012/0267144 A1 * 10/2012 Gebs ..... H01B 7/295 174/113 R

* cited by examiner

*Primary Examiner* — William H Mayo, III

(57) ABSTRACT

Plenum rated communication cables with reduced fluoropoloymer content may include a plurality of twisted pairs of individually insulated conductors, and each conductor may be insulated with a flame retardant polyolefin material. Additionally, each twisted pair may have a respective twist lay between approximately 0.30 inches and approximately 0.80 inches. The plurality of twisted pairs may be twisted together in a first direction and at least one of the plurality of twisted pairs may include conductors twisted together in a second direction opposite the first direction. A jacket may be formed around the plurality of twisted pairs.

20 Claims, 9 Drawing Sheets

PLENUM RATED TWISTED PAIR COMMUNICATION CABLES

TECHNICAL FIELD

Embodiments of the disclosure relate generally to communication cables and, more particularly, to twisted pair communication cables suitable for use in a plenum space that include conductors insulated with flame retardant polyolefin.

BACKGROUND

A wide variety of different types of communication cables are utilized to transmit information. For example, twisted pair communication cables are utilized to transmit Ethernet and other signals. As desire for enhanced communication bandwidth presses transmission media to convey information faster and more efficiently, communication cables are also required to maintain signal fidelity, avoid crosstalk, and satisfy other electrical performance criteria. The market further expects cost reduction to accompany advances in performance.

Communication cables are often deployed in applications involving fire performance considerations. For example, cables intended for installation in a plenum space typically must satisfy burn and smoke performance standards. The materials utilized for twisted pair insulation affect both the electrical performance and the fire performance of the twisted pair. Conventional materials offering improved electrical and fire performance typically impose higher costs. Accordingly, cable designers face challenges with achieving high electrical and flame performance objectives on the one hand and with meeting economic constraints on the other hand.

Fluoropolymers are often used as insulation material for high performance copper data cables that are specifically designed for plenum flame/smoke ratings. The desirable electrical characteristics of fluoropolymers generally provide low dielectric and dissipation properties, and most fluoropolymers further exhibit good flame/smoke properties when subjected to industry standard flame tests. Fluoropolymers, however, are often prohibitively expensive and are frequently in short supply. For example, fluorinated ethylene propylene ("FEP") offers desirable levels of electrical and fire performance, but is typically expensive and can be subject to supply shortages.

In order to reduce the cost of plenum-rated cables, attempts have been made to incorporate less costly flame retardant insulation materials into the cables. For example, plenum cables have been developed in which a portion of the twisted pairs utilize FEP insulation while the other twisted pairs utilize a flame retardant polyolefin insulation. While these cable constructions reduce the amount of FEP, they do not eliminate the use of FEP. Attempts have been made to replace FEP with flame retardant polyolefin compounds. However, the flame retardant polyolefin compounds have relatively worse electrical performance than FEP and non-flame retardant polyolefin compounds. This reduced performance has the potential to reduce the velocity of signal propagation along insulated conductors, thereby resulting in increased signal time delays that may fail to satisfy electrical performance requirements. Accordingly, an opportunity exist for improved plenum-rated communication cables that utilize flame retardant polyolefin insulation.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Various embodiments of the present disclosure are directed to plenum rated twisted pair communication cables, which may also be referred to as communication plenum ("CMP") cables. According to an aspect of the disclosure, a communication cable may include a plurality of twisted pairs of individually insulated conductors. Each twisted pair may include conductors insulated with a suitable flame retardant polyolefin material, such as flame retardant polypropylene or flame retardant polyethylene. In certain embodiments, each of the twisted pairs may utilize the same insulation material or materials. In other embodiments, at least two of the twisted pairs may utilize different insulation materials.

Additionally, the conductors of each twisted pair may be twisted together with a suitable twist lay. For example, each twisted pair may have a twist lay between approximately 0.30 inches and approximately 0.80 inches. In certain embodiments, each of the twisted pairs may have a different twist lay. In this regard, crosstalk between the twisted pairs may be reduced. Further, the plurality of twisted pairs may be twisted together within a cable with a suitable overall twist lay or bunch lay. In other words, the conductors of each pair may be twisted together to form a plurality of separate pairs, and the plurality of twisted pairs may then be twisted together.

According to an aspect of the disclosure, at least one of the twisted pairs may be twisted together in a direction that is opposite that of the overall twist lay or bunch lay. As a result, the twist lay of the twisted pair(s) may be reduced or loosened when the overall twist is formed in an opposite direction. This loosening may result in reducing the propagation delay of the twisted pair(s), thereby permitting the communication cable to satisfy relevant electrical performance standards. For example, the communication cable may satisfy relevant propagation delay and/or other performance standards set forth in the Category 6 ("Cat 6") or Category 6A ("Cat 6A") cabling standards and/or specifications.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
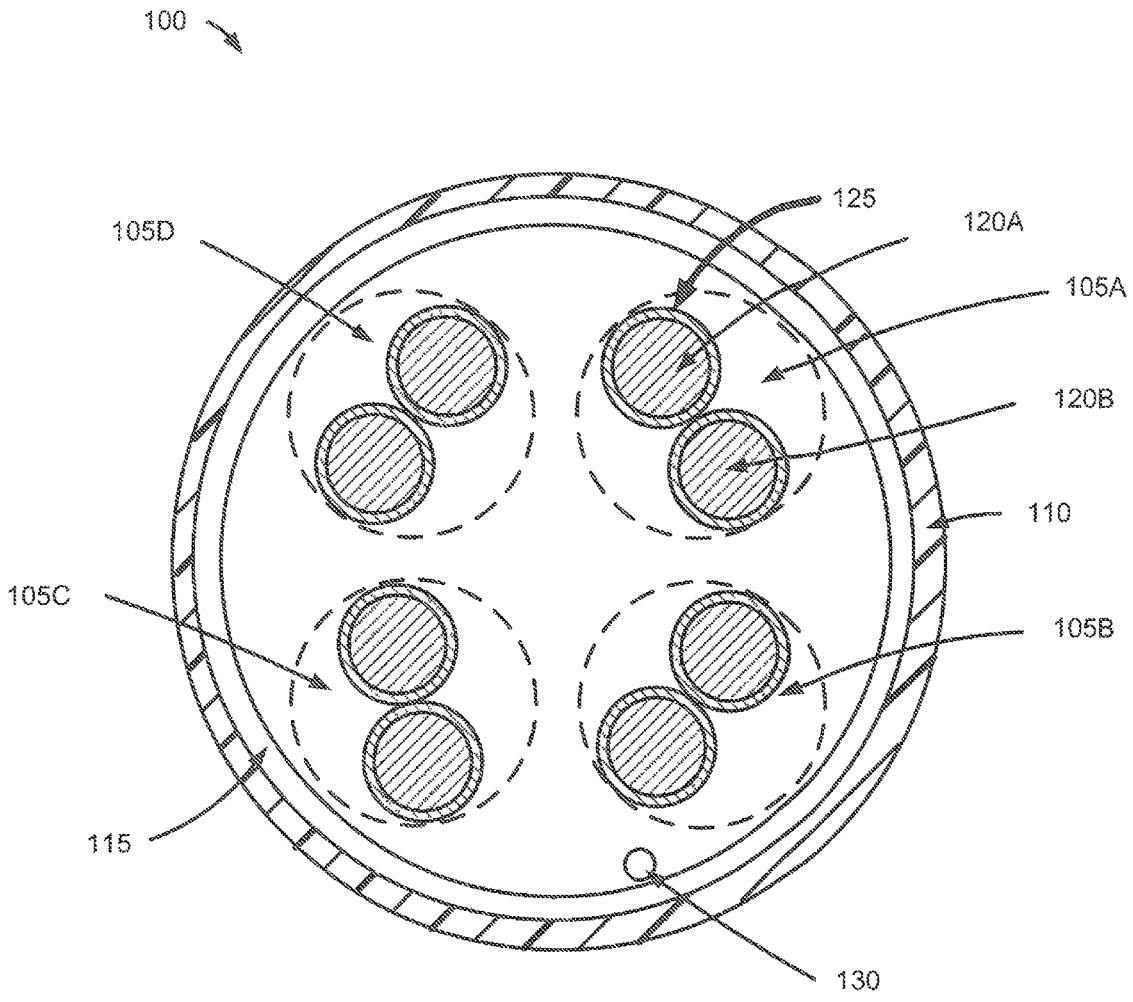
FIGS. 1-4 are cross-sectional views of example twisted pair communication cables, according to certain illustrative embodiments of the disclosure.

With reference to FIG. 1, a cross-section of an example cable 100 that may be utilized in various embodiments is illustrated. The cable 100 is illustrated as a twisted pair communications cable; however, embodiments of the disclosure may additionally be applicable to composite or hybrid cables that include a combination of twisted pairs and other transmission media (e.g., optical fibers, etc.). Indeed, suitable cables may include any number of transmission media including but not limited to one or more twisted pairs, optical fibers, coaxial cables, and/or power conductors.

As shown in FIG. 1, the cable 100 may include four twisted pairs 105A, 105B, 105C, 105D; however, any other suitable number of pairs may be utilized. Each twisted pair (referred to generally as twisted pair 105 or collectively as twisted pairs 105) may include two electrical conductors 120A, 120B, each covered with suitable insulation 125. As desired, each of the twisted pairs may have the same twist lay length (or twist lay) or alternatively, at least two of the twisted pairs may include a different twist lay. For example, in certain embodiments, each twisted pair may have a different twist lay. The different twist lays may function to reduce crosstalk between the twisted pairs. A wide variety of suitable twist lay configurations may be utilized. In certain embodiments, the differences between twist lays of twisted pairs 105 that are circumferentially adjacent one another (for example the twisted pair 105A and the twisted pair 105B) may be greater than the differences between twist lays of twisted pairs 105 that are diagonal from one another (for example the twisted pair 105A and the twisted pair 105C). As a result of having similar twist lays, the twisted pairs that are diagonally disposed can be more susceptible to crosstalk issues than the twisted pairs 105 that are circumferentially adjacent; however, the distance between the diagonally disposed pairs may limit the crosstalk. Thus, the different twist lays and arrangements of the pairs can help reduce crosstalk among the twisted pairs 105.

In certain embodiments, each of the twisted pairs 105 may have a twist lay between approximately 0.30 inches and approximately 0.80 inches. For example, each of the twisted pairs 105 may have a different twist lay with each respective twist lay being between approximately 0.30 inches and approximately 0.80 inches. In other example embodiments, two or more of the twisted pairs 105 may have the same twist lay. Additionally, as desired in other embodiments, one or more of the twisted pairs 105 may have twist lays that are less than 0.30 inches and/or that are greater than 0.80 inches. Indeed, a wide variety of suitable twist lays and/or combinations of twist lays may be utilized.

Additionally, the plurality of twisted pairs 105 may be twisted together with an overall twist or bunch. Any suitable overall twist lay or bunch lay may be utilized, such as a bunch lay between approximately 1.9 inches and approximately 15.0 inches. For example, a bunch lay may be approximately 1.9 inches, approximately 2.0 inches, approximately 2.5 inches, approximately 3.0 inches, approximately 4.0 inches, approximately 5.0 inches, approximately 6.0 inches, approximately 7.0 inches, approximately 8.0 inches, approximately 9.0 inches, approximately 10.0 inches, approximately 11.0 inches, approximately 12.0 inches, approximately 15.0 inches, or any value included in a range between two of the previously listed values. As another example, a bunch lay may be less than approximately 15.0 inches. In yet other example embodiments, a bunch lay may be greater than approximately 15.0 inches.

According to an aspect of the disclosure, at least one of the twisted pairs 105 may have a twist direction that is opposite that of the overall twist or bunch. In other words, the overall twist may be in a first direction (e.g., clockwise, counter clockwise), and at least one of the twisted pairs 105 may be twisted in a second direction opposite the first direction. In certain embodiments, a subset of the twisted pairs 105 may have a twist direction that is opposite that of the overall twist. In other embodiments, all of the twisted pairs 105 may have a twist direction that is opposite that of the overall twist. Indeed, FIGS. 6A-6D illustrate different combinations of twisted pairs that have a twist direction opposite that of the overall twist or bunch. Additionally, as desired in various embodiments, each of the twisted pairs 105 may be twisted in the same direction (e.g., clockwise, counter clockwise). In other embodiments, at least two of the twisted pairs 105 may be twisted in opposite directions.

As a result of the overall twist having an opposite twist direction of one or more twisted pairs, the overall twist may result in lengthening the twist lay of the one or more pairs. For example, a twisted pair may include a conductor that is insulated with one or more flame retardant polyolefin materials. The conductors of the twisted pair may be twisted together with a desired twist lay; however, the combination of the twist lay and the insulation material(s) may result in a twisted pair that has a propagation delay that fails to satisfy an applicable cable standard, such as a Category 6 or a Category 6A standard. When the twisted pair is incorporated into a plurality of a twisted pairs, and the plurality of pairs are twisted together in a direction opposite to that of the twisted pair, the twist lay of the twisted pair may be lengthened. In other words, by twisting the twisted pair in an opposite direction to that of the pair twist, the twist lay of the pair may be lengthened and/or loosened. As a result of this lengthening or loosening, the propagation delay of the pair may be reduced such that the pair satisfies an applicable cable standard, such as a Category 6 or a Category 6A standard. In other embodiments, the propagation delay of a pair may be reduced such that the pair satisfies a Category 8 standard.

An overall twist may loosen the twist lay of a twisted pair (i.e., a twisted pair having an opposite twist direction to the overall twist) by any desirable amount or percentage in various embodiments. In certain embodiments, an overall twist may loosen the twist lay of a twisted pair by between approximately 2.0 percent and approximately 73.0 percent. For example, a twist lay of a pair may be loosened by approximately 2.0 percent, approximately 3.0 percent, approximately 4.0 percent, approximately 5.0 percent, approximately 10.0 percent, approximately 15.0 percent, approximately 20.0 percent, approximately 25.0 percent, approximately 30.0 percent, approximately 40.0 percent, approximately 50.0 percent, approximately 60.0 percent, approximately 70.0 percent, approximately 73.0 percent, or by any percentage included in a range between two of the previously mentioned values.

Similarly, an overall twist may increase a twist lay of a twisted pair by any desirable amount or value in various embodiments. For example, in certain embodiments, an overall twist may lengthen or increase a twist lay of a twisted pair by between approximately 0.006 inches and approximately 0.582 inches. For example, a pair twist lay may be increased by approximately 0.005 inches, approximately 0.006 inches, approximately 0.0075 inches, approximately 0.01 inches, approximately 0.0125 inches, approximately 0.015 inches, approximately 0.0175 inches, approximately 0.02 inches, approximately 0.05 inches, approximately 0.1 inches, approximately 0.2 inches, approximately 0.3 inches, approximately 0.4 inches, approximately 0.5 inches, approximately 0.582 inches, or any value included in a range between two of the previously mentioned values. In other example embodiments, a pair twist lay may be increased by greater than approximately 0.006 inches, approximately 0.01 inches, approximately 0.015 inches, or approximately 0.02 inches. Additionally, in certain embodiments, the lay of an overall twist may be selected in order to achieve a desired twist lay loosening and/or lengthening of one or more twisted pairs.

In certain example embodiments, a twist lay of a twisted pair may be between approximately 0.30 inches and approximately 0.80 inches. Additionally, an overall twist or bunch lay may vary between approximately 1.90 inches, and approximately 15.0 inches. Given these values, example minimum and maximum twist lay loosening values are set forth in Table I below. A wide variety of other twist lay loosening values may be achieved with different twist lay and bunch lay values, and the values set forth in Table I are provided by way of non-limiting example only.

TABLE 1

Example Twist Lay Loosening Values

| Twist Lay Length (Inches) | Bunch Lay Length (inches) | Cable Spike | Twist Lay Length After Bunching (Inches) | Amount of Loosening (Inches) |
|---|---|---|---|---|
| 0.300 | 1.900 | 2000 MHz (Cat 8) | 0.356 | 0.056 |
| 0.800 | 1.900 | 2000 MHz (Cat 8) | 1.382 | 0.582 |
| 0.300 | 15.00 | 250 MHz (Cat 6) | 0.306 | 0.006 |
| 0.800 | 15.00 | 250 MHz (Cat 6) | 0.845 | 0.045 |

As desired in certain embodiments, one or more suitable bindings or wraps may be wrapped or otherwise formed around the twisted pairs 105 once they are twisted together. Additionally, in certain embodiments, multiple grouping of twisted pairs may be incorporated into a cable. As desired, each grouping may be twisted, bundled, and/or bound together. Further, in certain embodiments, the multiple groupings may be twisted, bundled, or bound together.

With continued reference to FIG. 1, the electrical conductors (generally referred to as conductor 120) of a twisted pair 105 may be formed from any suitable electrically conductive material, such as copper, aluminum, silver, annealed copper, gold, a conductive alloy, etc. Additionally, the electrical conductors 120 may have any suitable diameter, gauge, and/or other dimensions. Further, each of the electrical conductors 120 may be formed as either a solid conductor or as a conductor that includes a plurality of conductive strands that are twisted together.

The twisted pair insulation 125 may include any suitable dielectric materials and/or combination of materials. Examples of suitable dielectric materials include, but are not limited to, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins, a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105 may be formed from similar materials. In other embodiments, at least two of the twisted pairs may utilize different insulation materials. In yet other embodiments, the two conductors that make up a twisted pair may utilize different insulation materials.

According to an aspect of the disclosure, at least one of the twisted pairs 105 may have insulation 125 that is formed from or that includes one or more flame retardant polyolefin materials. In certain embodiments, all of the twisted pairs 105 may have insulation that is formed from or that includes one or more flame retardant polyolefin materials. Examples of suitable flame retardant polyolefin materials include, but are not limited to, flame retardant polypropylene ("FRPP"), flame retardant polyethylene ("FRPE"), and/or other suitable flame retardant polyolefins.

In certain embodiments, the twisted pair insulation 125 may be formed from multiple layers of one or a plurality of suitable materials. In other embodiments, the insulation 125 may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as smoke suppressant materials, etc. A few non-limiting examples of different types of insulation are discussed in greater detail below with reference to FIGS. 7A-7C.

Each twisted pair 105 can carry data or some other form of information, for example in a range of about one to ten Giga bits per second ("Gbps") or another appropriate frequency, whether faster or slower. In certain embodiments, each twisted pair 105 supports data transmission of about two and one-half Gbps (e.g. nominally two and one-half Gbps), with the cable 100 supporting about ten Gbps (e.g. nominally ten Gbps). In certain embodiments, each twisted pair 105 supports data transmission of up to about ten Gbps (e.g. nominally ten Gbps), with the cable 100 supporting about forty Gbps (e.g. nominally forty Gbps).

With continued reference to FIG. 1, a jacket 110 may enclose the internal components of the cable 100, seal the cable 100 from the environment, and/or provide strength and structural support. The jacket 110 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 110 may be formed as a single layer or, alternatively, as multiple layers. In certain embodiments, the jacket 110 may be formed from one or more layers of foamed material. As desired, the jacket 110 can include flame retardant and/or smoke suppressant materials. The jacket 110 may be formed to result in a round cable or a cable having an approximately circular cross-section; however, the jacket 110 and internal components may be formed to result in other desired shapes, such as an elliptical, oval, or rectangular shape. The jacket 110 may also have a wide variety of suitable dimensions, such as any suitable or desirable outer diameter and/or any suitable or desirable wall thickness. In various embodiments, the jacket 110 can be characterized as an outer jacket, an outer sheath, a casing, a circumferential cover, or a shell.

An opening enclosed by the jacket 110 may be referred to as a cable core, and the twisted pairs 105 may be disposed within the cable core 125. Although a single cable core is illustrated in the cable 100 of FIG. 1, a cable may be formed to include multiple cable cores. In certain embodiments, the cable core may be filled with a gas such as air (as illustrated) or alternatively a gelatinous, solid, powder, moisture absorbing material, water-swellable substance, dry filling compound, or foam material, for example in interstitial spaces between the twisted pairs 105. Other elements can be added to the cable core as desired, for example one or more optical fibers, additional electrical conductors, additional twisted pairs, water absorbing materials, and/or strength members, depending upon application goals.

Figure 2:
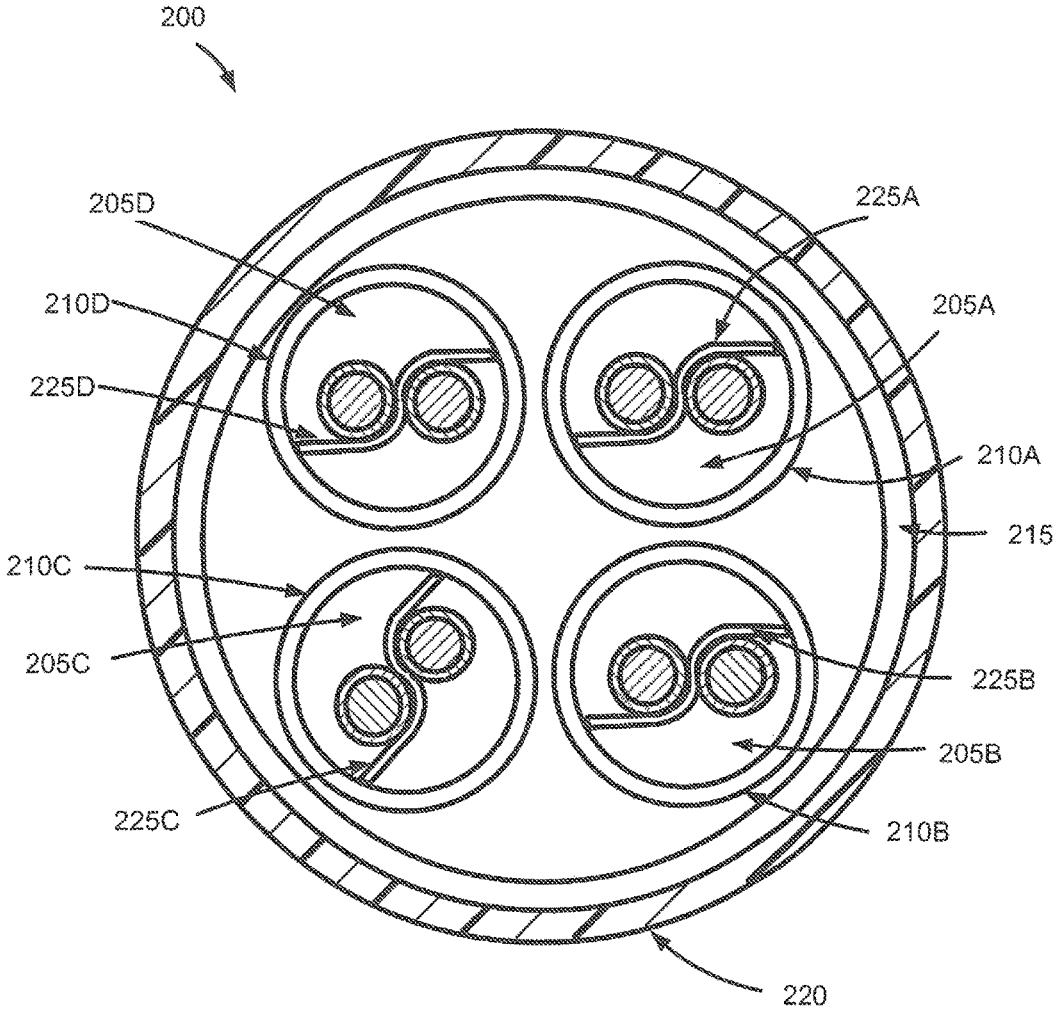
Figure 3:
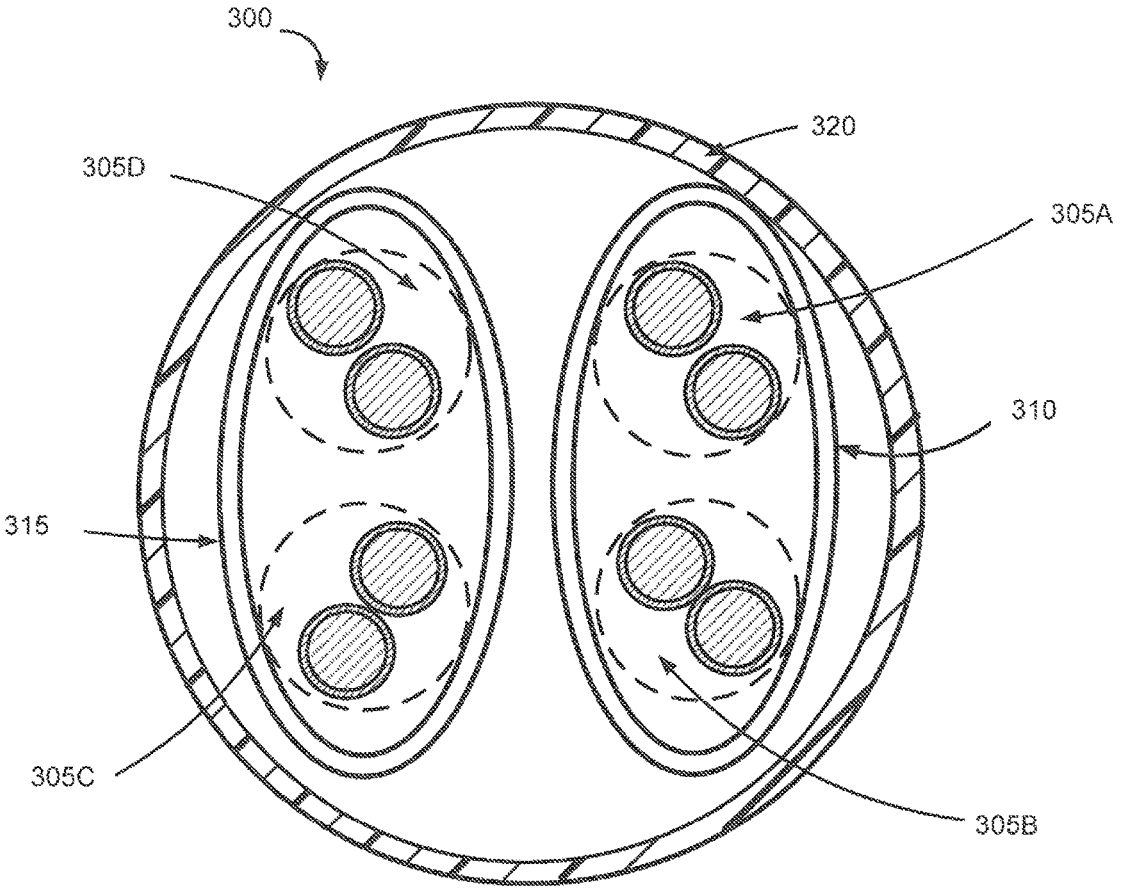

In certain embodiments of the disclosure, one or more shield elements or shielding elements may be incorporated into the cable 100. As shown in FIG. 1, an overall shield 115 or shield layer may be formed around the plurality of twisted pairs 105. As illustrated in FIG. 2, in other embodiments, individual shield layers may be respectively formed around each of the twisted pairs. In yet other embodiments, and as shown in FIG. 3, one or more shield layers may be formed around desired subgroups of the twisted pairs 105. As desired, shielding material may also be incorporated into cable separators or fillers positioned between two or more of the pairs 105 and/or into separators positioned between the individual conductors of a twisted pair. Indeed, a wide variety of suitable shielding configurations may be utilized.

In certain embodiments, a shield layer, such as the shield layer 115 illustrated in FIG. 1, may be positioned within a cable core. In other embodiments, a shield layer may be incorporated into the outer jacket 110. For example, the shield layer 115 may be sandwiched between two other layers of outer jacket material, such as two dielectric layers. As another example, electrically conductive material may be injected or inserted into the outer jacket 110 or, alternatively, the outer jacket 110 may be impregnated with electrically conductive material. A wide variety of other suitable shielding arrangements may be utilized as desired in other embodiments. Further, in certain embodiments, a cable may include a separate, armor layer (e.g., a corrugated armor, etc.) for providing mechanical protection.

The external shield 115 will now be described herein in greater detail; however, it will be appreciated that other shield layers may have similar constructions. In certain embodiments, a shield 115 may be formed from a single segment or portion that extends along a longitudinal length of the cable 115. In other embodiments, a shield 115 may be formed from a plurality of discrete segments or portions positioned adjacent to one another along a longitudinal length of the cable 100. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable.

As desired, a wide variety of suitable techniques and/or processes may be utilized to form a shield 115 (or a shield segment). As another example, a base material or dielectric material may be extruded, pultruded, or otherwise formed. Electrically conductive material may then be applied to the base material. In other embodiments, electrically conductive material may be injected into the base material. In other embodiments, dielectric material may be formed or extruded over electrically conductive material in order to form a shield 115. Indeed, a wide variety of suitable techniques may be utilized to incorporate electrically conductive material into a shield 115. In certain embodiments, the base layer may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer.

In certain embodiments, the shield 114 (or individual shield segments) may be formed as a tape that includes both a dielectric layer and an electrically conductive layer (e.g., copper, aluminum, silver, an alloy, etc.) formed on one or both sides of the dielectric layer. Examples of suitable materials that may be used to form a dielectric layer include, but are not limited to, various plastics, one or more polymeric materials, one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, aramid materials, or dielectric material (s) that does not ordinarily conduct electricity. In certain embodiments, a separate dielectric layer and electrically conductive layer may be bonded, adhered, or otherwise joined (e.g., glued, etc.) together to form the shield 115. In other embodiments, electrically conductive material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the conductive patches can be over-coated with an electrically insulating film, such as a polyester coating. Additionally, in certain embodiments, an electrically conductive layer may be sandwiched between two dielectric layers. In other embodiments, at least two electrically conductive layers may be combined with any number of suitable dielectric layers to form the shield 114. For example, a four layer construction may include respective electrically conductive layers formed on either side of a first dielectric layer. A second dielectric layer may then be formed on one of the electrically conductive layers to provide insulation between the electrically conductive layer and the twisted pairs 105. Indeed, any number of suitable layers of material may be utilized in a shield 115.

In certain embodiments, a cable may be formed without a separator being positioned between two or more of the pairs of the cable. Indeed, various embodiments of the disclosure have a cable construction that permits the resulting cable to satisfy applicable electrical and fire standards without incorporating a separator or filler. The example cable constructions illustrated in FIGS. 1-3 do not include a separator positioned between two or more of the pairs. In certain other embodiments, such as the cable illustrated in FIG. 4, a separator may be positioned between two or more of the pairs. In the event that a separator is incorporated into a cable, the separator may include a wide variety of suitable constructions. Additionally, in certain embodiments, a separator may incorporate electrically conductive material that provides for shielding between two or more of the twisted pairs.

Additionally, in certain embodiments, one or more separator elements may be positioned between the individual conductors of a twisted pair. These separator elements may have a wide variety of suitable constructions and/or components. FIG. 2 illustrates an example cable that includes respective dielectric film separator elements positioned between the conductors of the various twisted pairs. Other embodiments may include other types of separator elements. Additionally, as desired in certain embodiments, a separator that is at least partially positioned or situated between twisted pair conductors may include electrically conductive material that provides a shielding function.

As set forth above, a wide variety of different components of a cable may function as shielding elements. In certain embodiments, the electrically conductive material incorporated into a shield element may be relatively continuous along a longitudinal length of a cable. For example, a relatively continuous foil shield or braided shield may be utilized. In other embodiments, a shield element may be formed as a discontinuous shield element having a plurality of isolated electrical patches. For continuous shield elements (e.g., non-overlapping shield elements), a plurality of patches of electrically conductive material may be incorporated into the shield element, and gaps or spaces may be present between adjacent patches in a longitudinal direction. For segmented shield elements formed from a plurality of discrete segments, each segment or section of the shield element may include either a single patch of electrically conductive material or a plurality of electrically conductive patches with gaps or spaces between adjacent patches. A wide variety of different patch patterns may be formed as desired in various embodiments, and a patch pattern may include a period or definite step. In other embodiments, patches may be randomly formed or situated on a carrier layer. As desired, any number of carrier layers and electrically conductive layers may be utilized within a shield element or segment of a shield element.

A wide variety of suitable electrically conductive materials or combination of materials may be utilized to form electrically conductive patches incorporated into a shield element including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C.

Additionally, individual patches may be separated from one another so that each patch is electrically isolated from the other patches. That is, the respective physical separations between the patches may impede the flow of electricity between adjacent patches. In certain embodiments, the physical separation of patches may be formed by gaps or spaces, such as gaps of dielectric material. In other embodiments, the physical separation of certain patches may result from the overlapping of shield segments. For example, a shield element may be formed with from a plurality of discrete segments, and adjacent segments may overlap one another. The respective physical separations between the patches may impede the flow of electricity between adjacent patches.

The components of a shield element or various segments of a shield element may include a wide variety of suitable dimensions, for example, any suitable lengths in the longitudinal direction and/or any suitable thicknesses. A dielectric portion included in a shield element or segment may have any desired thickness. Additionally, each electrically conductive patch may include a coating of metal (or other material) having any desired thickness, such as a thickness of about 0.5 mils (about 13 microns) or greater. For example, electrically conductive patches may have a thickness between approximately 1.0 mil (25.4 microns) and approximately 3.0 mils 76.2 microns. In some applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. A greater thickness may limit negative insertion loss characteristics.

In certain embodiments, an electrically conductive patch may cover substantially an entire area of shield element or shield element segment (e.g., substantially the entire surface on one side of a carrier layer, etc.). In other embodiments, a plurality of electrically conductive patches may be formed on a given shield element or shield element segment. A wide variety of segment and/or patch lengths (e.g., lengths along a longitudinal direction of a cable) may be utilized. As desired, the dimensions of the segments and/or electrically conductive patches can be selected to provide electromagnetic shielding over a specific band of electromagnetic frequencies or above or below a designated frequency threshold. In various embodiments, the segments and/or patches can have a length of about 0.5, 0.75, 1.0, 1.5, 2.0, 2.5, 3.0, 3.5, 4.0, 4.5, or 5.0 meters or in a range between any two of these values. In other embodiments, lengths may be less than 0.5 meters or greater than 5.0 meters.

In the event that a plurality of patches is formed on a shield element or a shield element segment, a wide variety of suitable gap distances or isolation gaps may be provided between adjacent patches. For example, the isolation spaces can have a length of about 0.5, 1.0, 1.5, 2.0, 2.5, 3.0, 3.5, or 4 millimeters or in a range between any two of these values. In one example embodiment, each patch may be at least two meters in length, and a relatively small isolation gap (e.g., 4 millimeters or less, about 1/16 of an inch, etc.) may be formed between adjacent patches. Additionally, the patches may be formed as first patches (e.g., first patches on a first side of a dielectric material), and second patches may be formed on an opposite side of the dielectric material (or on another dielectric material). For example, second patches may be formed to correspond with the gaps or isolation spaces between the first patches. As desired, the electrically conductive patches may have a wide variety of different shapes and/or orientations. For example, the segments and/or patches may have a rectangular, trapezoidal, or parallelogram shape. A few example shapes for patches are described in greater detail below with reference to FIGS. 9A-9D.

In certain embodiments, a gap or space between adjacent patches may be formed from a plurality of microcuts formed in series through the electrically conductive patch material. For example, a series of relatively small or thin cuts, such as cuts having a width of approximately 0.25 mm, may be formed over an area corresponding to a conventional gap between patches (e.g., a longitudinal width of at least 0.050 inches). Each microcut may be formed through the electrically conductive material or partially through the electrically conductive material. Shielding elements with microcuts may provide for reduced or limited leakage, provide for reduced noise, and/or provide for reduced crosstalk relative to conventional shields. Additionally, it is noted that the use of singular microcuts at spaced intervals may allow electricity to arc across the microcuts, thereby leading to a safety hazard. However, a plurality of microcuts positioned or formed in relatively close proximity to one another may limit safety risks due to electrical arcing. Any electrical arcing across the microcut gaps will likely burn up or destroy the electrically conductive material between the closely spaced microcuts, thereby breaking or severing the electrical continuity of the shielding element and preventing current from propagating down the shielding element.

Although the examples above describe situations in which conventional spaces or gaps are respectively replaced with a series of microcuts, a wide variety of other suitable configurations of microcuts may be utilized as desired. For example, in certain embodiments, a shielding element may include microcuts continuously spaced in close proximity to one another along a longitudinal length of the shielding element. In other embodiments, sections or patches of microcuts may be spaced at regular intervals or in accordance with any desired pattern. Each section or patch may include at least two microcuts. In yet other embodiments, sections or patches of microcuts may be positioned in random locations along a shielding element. In yet other embodiments, a section of microcuts may include microcuts that form one or more alphanumeric characters, graphics, and/or logos.

In certain embodiments, electrically conductive patches may be formed to be approximately perpendicular (e.g., square or rectangular segments and/or patches) to the longitudinal axis of the adjacent one or more twisted pairs (e.g., pairs enclosed by a shield, pairs adjacent to a separator, etc.). In other embodiments, the patches may have a spiral direction that is opposite the twist direction of the enclosed one or more pairs. That is, if the twisted pair(s) are twisted in a clockwise direction, then the segments and/or patches may spiral in a counterclockwise direction. If the twisted pair(s) are twisted in a counterclockwise direction, then the conductive patches may spiral in a clockwise direction. Thus, twisted pair lay opposes the direction of the segment and/or patch spiral. The opposite directions may provide an enhanced level of shielding performance. In other embodiments, the segments and/or patches may have a spiral direction that is the same as the twist direction of the enclosed one or more pairs.

In certain embodiments, one or more techniques may be utilized to reduce and/or eliminate electrical perturbations between conductive patches and/or at the circumferential edges of a shield element. As one example technique, in certain embodiments, one or more electrically conductive patches included in a shield element may be electrically shorted or electrically continuous along a circumferential direction of the shield element. As another example technique, a shield element may be formed with overlapping segments in order to effectively eliminate longitudinal spaces or gaps between adjacent patches formed on the shield element. Each of these techniques are described in greater detail below.

In certain embodiments, one or more electrically conductive patches included in a shield element may be electrically shorted or continuous along a circumferential direction. For example, when a shield layer is wrapped around one or more twisted pairs, one or more the patch(es) formed on the shield may contact one another such that a relatively continuous patch is formed around the outer circumference of the shield. When one or more patches are electrically shorted in a circumferential direction, electrical perturbations caused by the shield element may be reduced relative to conventional cables. Therefore, a cable may exhibit improved electrical performance, such as reduced return loss and/or reduced cross-talk loss.

A wide variety of suitable methods or techniques may be utilized to electrically short patches in a circumferential direction. For example, electrically conductive material may extend beyond an edge of the dielectric material at one or more locations such that a patch contacts itself when the shield layer is wrapped around one or more pairs. As another example, electrically conductive material may be formed on both sides of a dielectric substrate at one or more locations along an edge of the dielectric substrate such that a patch is shorted to itself when the shield layer is wrapped around one or more pairs. As another example, a shield layer may be folded over itself at one or more points along or near an edge such that one or more patches are electrically shorted to themselves. As yet another example, gaps or electrically conductive vias may be formed through the dielectric substrate at one or more locations at or near an edge of a shield layer such that electrically conductive patches may be shorted to themselves. Other suitable techniques may be utilized as desired.

In certain embodiments, at least one shield element, such as the shield layer 115 illustrated in FIG. 1, may be formed to include overlapping segments. As desired, a shield element may be formed to include a plurality of electrically conductive patches arranged in a discontinuous manner. In other words, the electrically conductive patches may be electrically isolated from one another. However, in contrast to conventional shield elements, the shield element may not include spaces or gaps between certain patches along a longitudinal direction of the cable. The shield element may include a plurality of discrete overlapping segments or sections along a longitudinal length of the cable, and each segment may include at least one electrically conductive patch or portion. The combination of the segments may form a discontinuous shield element; however, the overlapping nature of the segments may eliminate gaps between certain patches along a longitudinal direction. Thus, the discontinuous shield element may exhibit improved electrical performance relative to conventional discontinuous shields.

When forming a shield element, each shield element segment may include a carrier layer (e.g., a dielectric layer, etc.) with one or more electrically conductive patches formed thereon. Adjacent segments may be positioned so that an end of a first segment (e.g., a second or distal end along the longitudinal direction or length of a cable) is overlapped by the first end of a second segment. In other words, the segments may be incorporated into a cable to include overlapping edges along a length of the cable. Further, the carrier layers of the shield segments may provide isolation between the electrically conductive patches formed on each segment. For example, at an overlapping region, a first segment may include an electrically conductive patch formed on a dielectric material. A second segment may have a similar construction. When incorporated into the cable, the dielectric material of the second segment may be positioned over, positioned around, and/or in contact with the electrically conductive patch of the first segment at the overlapping region. Thus, electrical isolation exists between the electrically conductive patch of the first segment and the electrically conductive patch of the second segment.

With continued reference to FIG. 1, in certain embodiments, a drain wire 130 may be incorporated into the cable. For example, a drain wire may be utilized if one or more relatively continuous shields, such as foil shields, are incorporated into the cable. A drain wire 130 may be formed from a wide variety of suitable materials. For example, a drain wire 130 may be formed from tinned copper.

FIG. 2 illustrates a cross-sectional view of another example cable 200 that may be utilized in various embodiments of the disclosure. The cable 200 may include similar components to the cable 100 of FIG. 1. For example, the cable 200 may include a plurality of twisted pairs 205A-D, and an overall shield 215 may optionally be formed around the plurality of twisted pairs 205A-D. Additionally, a jacket 220 may be formed around the twisted pairs 205A-D and the overall shield 215.

According to an aspect of the disclosure, one or more of the twisted pairs may include insulation formed at least in part from one or more flame retardant polyolefin materials. Additionally, each of the twisted pairs may have a suitable twist lay, such as a twist lay between approximately 0.30 inches and approximately 0.80 inches. The plurality of twisted pairs may also be twisted together with a suitable bunch lay. Further, the twist direction of at least one of the twisted pairs may be opposite that of the bunch twist direction.

With continued reference to FIG. 2, one or more of the twisted pairs 205A-D may include an individual shield layer. As shown, each of the twisted pairs has a respective pair shield layer. For example, a first shield layer 210A is formed around a first twisted pair 205A; a second shield layer 210B is formed around a second twisted pair 205B; a third shield layer 210C is formed around a third twisted pair 205C; and a fourth shield layer 210D is formed around a fourth twisted pair 205D.

Additionally, one or more twisted pair separators may be incorporated into the cable 200. As shown in FIG. 2, each of the twisted pairs has a respective twisted pair separator positioned between the individual conductors of the pair. For example, a first separator 225A is associated with a first twisted pair 205A; a second separator 225B is associated with a second twisted pair 205B; a third separator 225C is associated with a third twisted pair 205A; and a fourth separator 225D is associated with a fourth twisted pair 205D. Other cable constructions may include more or less twisted pair separators. For example, only a portion of the twisted pairs may include an associated separator. Further, FIG. 2 illustrates twisted pair separators that have similar constructions. In other embodiments, at least two twisted pair separators may be formed utilizing different materials, configurations, and/or constructions.

Each twisted pair separator (generally referred to as separator 225) may be woven helically with the individual conductors or conductive elements of an associated twisted pair 205. In other words, a separator 225 may be helically twisted with the conductors of a twisted pair 205 along a longitudinal length of the cable 200. Additionally, each separator 225 may have a wide variety of suitable constructions and/or cross-sectional shapes. As shown, in FIG. 2, each separator may be formed as a dielectric film that is positioned between the two conductors of a twisted pair 205. In other embodiments, a separator 225 may be formed with an H-shape, an X-shape, or any other suitable cross-sectional shape. For example, the separator 225 may be formed to create or define one or more channels in which the twisted pair conductors may be situated. In this regard, the separator 225 may assist in maintaining the positions of the twisted pair conductors when stresses are applied to the cable, such as pulling and bending stresses. As desired, electrically conductive material may be incorporated into one or more portions of a separator 225 in order to provide shielding for the twisted pair conductors.

In certain embodiments, a separator 225 may include a first portion that is positioned between the conductors of a twisted pair 205 and one or more second portions that form a shield around an outer circumference of the twisted pair. The first portion may be helically twisted between the conductors, and the second portion(s) may be helically twisted around the conductors as the separator 225 and the pair 205 are twisted together. The first portion or dielectric portion may assist in maintaining spacing between the individual conductors of the twisted pair 205 and/or maintaining the positions of one or both of the individual conductors. The second portion(s) or shielding portions may extend from the first portion, and the second portion(s) may be individually and/or collectively wrapped around the twisted pair conductors in order to form a shield layer. Electrically conductive material may be incorporated into the second portion(s) in order to provide shielding. Additionally, the shielding portion(s) of separator 225 may assist in maintaining the positions of one or both of the individual conductors.

FIG. 3 illustrates a cross-sectional view of another example cable 300 that may be utilized in various embodiments of the disclosure. The cable 300 may include similar components to the cable 100 of FIG. 1. For example, the cable 300 may include a plurality of twisted pairs 305A-D, and a jacket 320 may be formed around the twisted pairs 305A-D. However, the cable 300 of FIG. 3 is illustrated as having shield layers formed around groups of twisted pairs. For example, a first shield layer 310 may be formed around two of the twisted pairs 305A, 305B, and a second shield layer 315 may be formed around the other two twisted pairs 305C, 305D. Indeed, as illustrated in FIGS. 1-3, a wide variety of suitable shielding arrangements may be utilized.

Figure 4:
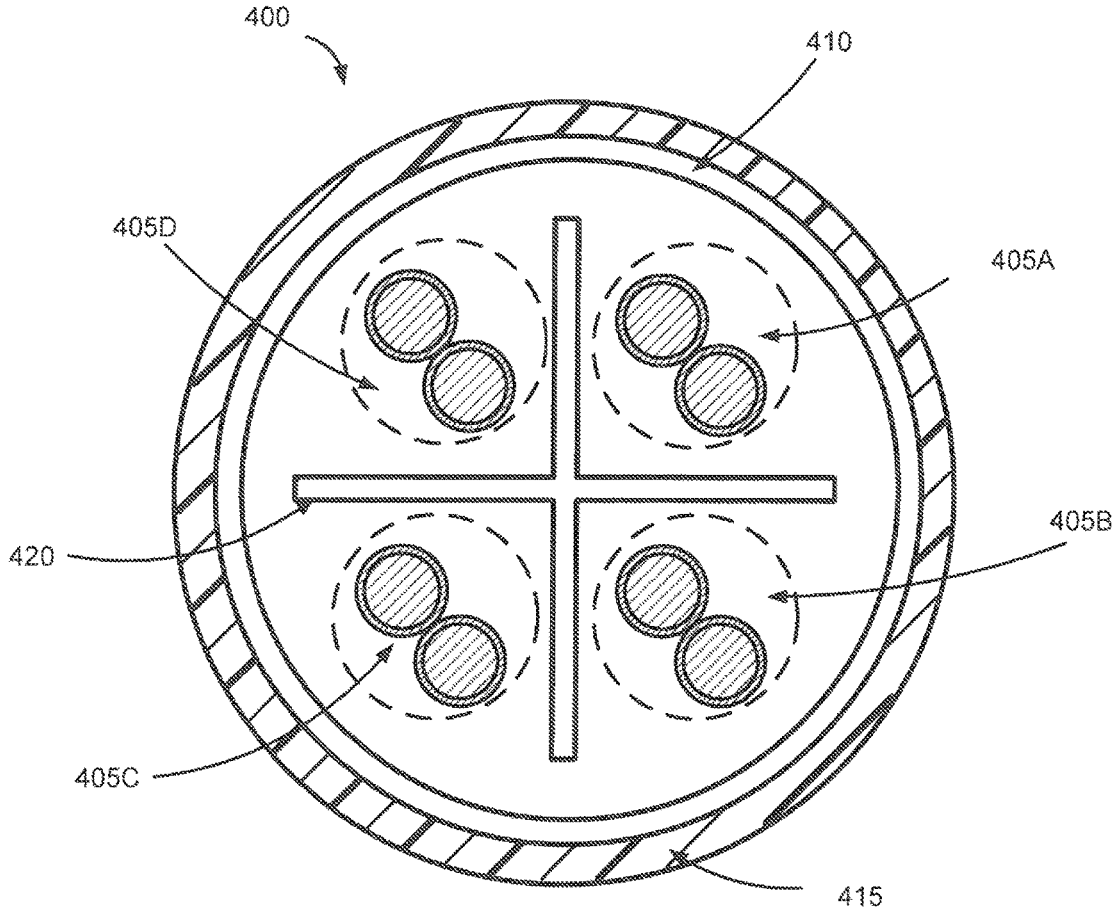

FIG. 4 illustrates a cross-sectional view of another example cable 400 that may be utilized in various embodiments of the disclosure. The cable 400 may include similar components to the cable 100 of FIG. 1. For example, the cable 400 may include a plurality of twisted pairs 405A-D, and an overall shield 410 may optionally be formed around the plurality of twisted pairs 405A-D. Additionally, a jacket 415 may be formed around the twisted pairs 405A-D and the overall shield 410.

Although FIGS. 1-3 illustrate example cables that do not have a separator or filler positioned between two or more of the twisted pairs, the cable 400 of FIG. 4 is illustrated as including a suitable separator 420, spline, or filler positioned between two or more pairs. The separator 420 may be disposed within the cable core and configured to orient and or position one or more of the twisted pairs 405A-D. The orientation of the twisted pairs 405A-D relative to one another may provide beneficial signal performance. As desired in various embodiments, the separator 420 may be formed in accordance with a wide variety of suitable dimensions, shapes, or designs. For example, a rod-shaped separator, a flat tape separator, a flat separator, an X-shaped or cross-shaped separator, a T-shaped separator, a Y-shaped separator, a J-shaped separator, an L-shaped separator, a diamond-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized. In certain embodiments, material may be cast or molded into a desired shape to form the separator 210. In other embodiments, a tape may be formed into a desired shape utilizing a wide variety of folding and/or shaping techniques. For example, a relatively flat tape separator may be formed into an X-shape or cross-shape as a result of being passed through one or more dies.

The separator 420 may be formed from a wide variety of suitable materials as desired in various embodiments. For example, a separator 410 can include paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, the separator 420 may be filled, unfilled, foamed, un-foamed, homogeneous, or inhomogeneous and may or may not include additives (e.g., flame retardant and/or smoke suppressant materials). Additionally, in certain embodiments, electrically conductive material may be incorporated into a separator 420. As a result of incorporating electrically conductive material, the separator 420 may function as a shielding element.

As desired in various embodiments, a wide variety of other materials may be incorporated into a cable, such as the cables 100, 200, 300, 400 illustrated in FIGS. 1-4. For example, as set forth above, a cable may include any number of conductors, twisted pairs, optical fibers, and/or other transmission media. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cables illustrated in FIGS. 1-4 are provided by way of example only. Embodiments of the disclosure contemplate a wide variety of other cables and cable constructions. These other cables may include more or less components than the cables illustrated in FIGS. 1-4. Additionally, certain components may have different dimensions and/or materials than the components illustrated in FIGS. 1-4.

Figure 5:
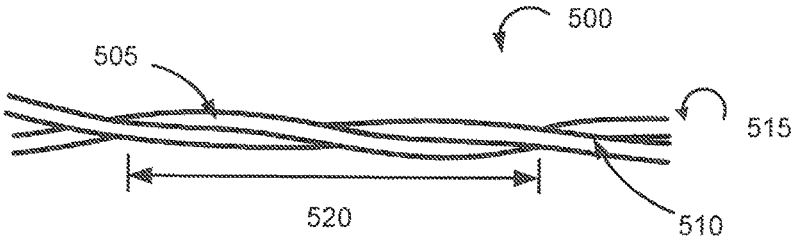
FIG. 5 illustrates two conductors that are twisted together to form a twisted pair that may be utilized in various embodiments of the disclosure.

According to an aspect of the disclosure, a cable may include a plurality of twisted pairs. FIG. 5 illustrates the formation of a twisted pair 500 from two conductor 505, 510. The two conductors 505, 510 may be twisted around each other or twined together in a suitable twist direction 515. Additionally, the two conductors 505, 510 may be twisted together with any suitable twist lay 520, which is the longitudinal length required for the two conductors 505, 510 to make a complete twist around one another. In certain embodiments, the twist lay 520 may be between approximately 0.30 inches and approximately 0.80 inches. The twisted pair 500 illustrated in FIG. 5 may be incorporated into a wide variety of suitable cable designs, such as any of the cables 100, 200, 300, 400 illustrated in FIGS. 1-4.

Figure 6A:
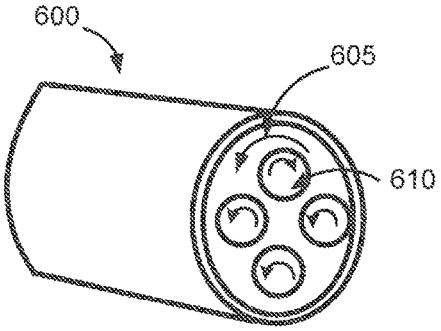
FIGS. 6A-6D illustrate example cable cores in which one or more twisted pairs have a twist direction that is opposite that of an overall twist direction or bunch lay, according to illustrative embodiments of the disclosure.

FIGS. 6A-6D illustrate example cable cores in which one or more twisted pairs have a twist direction that is opposite that of an overall twist direction or bunch lay, according to illustrative embodiments of the disclosure. With reference to FIG. 6A, a first example cable core 600 is illustrated. The cable core 600 includes a plurality of twisted pairs that are twisted together in a bunch direction 605. As shown, one of the twisted pairs 610 has a twist direction that is opposite that of the bunch direction 605 while the remaining twisted pairs have a twist direction that is the same as the bunch direction 605. For example, the twisted pair having the shortest lay length may have a twist direction opposite that of the bunch direction 605.

Figure 6B:
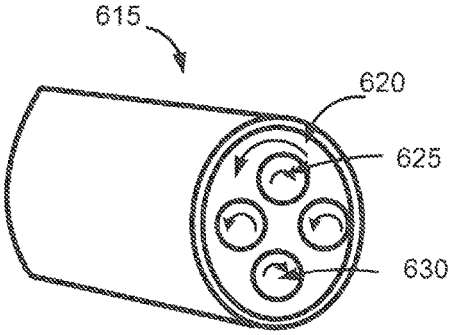

FIG. 6B illustrates another example cable core 615 in which a plurality of twisted pairs are twisted together in a bunch direction 620. Two of the twisted pairs 625, 630 have a twist direction that is opposite that of the bunch direction 620, and the other two twisted pairs may have a twist direction that is the same as the bunch direction 620. Although the twisted pairs 625, 630 having a twist direction opposite the bunch direction 620 are illustrated as being diagonally across from one another in the cable core 615, any two of the twisted pairs may have a twist direction opposite the bunch direction 620.

Figure 6C:
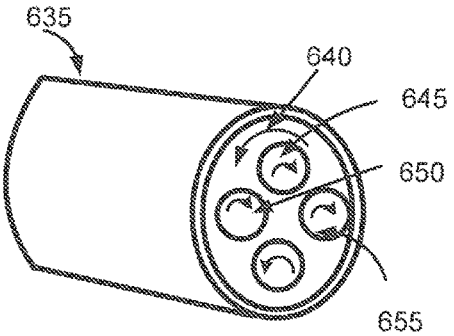
Figure 6D:
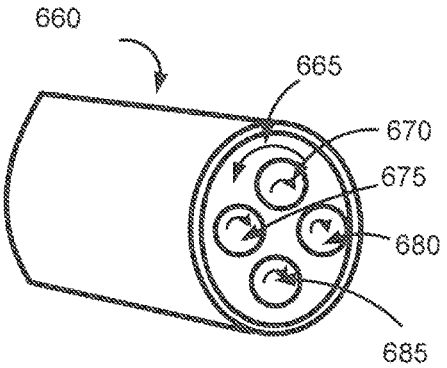

FIG. 6C illustrates another example cable core 635 in which are plurality of twisted pairs are twisted together in a bunch direction 640. In FIG. 6C, three of the twisted pairs 645, 650, 655 may have a twist direction opposite that of the bunch direction 640 while the remaining twisted pair has a twist direction that is the same as the bunch direction 640. FIG. 6D illustrates yet another example cable core 660 having a plurality of twisted pairs twisted together in a bunch direction 665. In the cable core 660 of FIG. 6D, all of the twisted pairs 670, 675, 680, 685 have a twist direction that is opposite that of the bunch direction 665.

Any of the cable core constructions illustrated in FIGS. 6A-6D may be utilized in various embodiments of the disclosure. For example, the various twisted pairs illustrated in FIGS. 1-4 may have twist directions that are the same as any of those illustrated in FIGS. 6A-6D. In other embodiments, more or less twisted pairs may be incorporated into a cable, and any suitable configuration of twist directions may be utilized provided that at least one pair has a twist direction opposite that of the bunch direction.

Figure 7A:
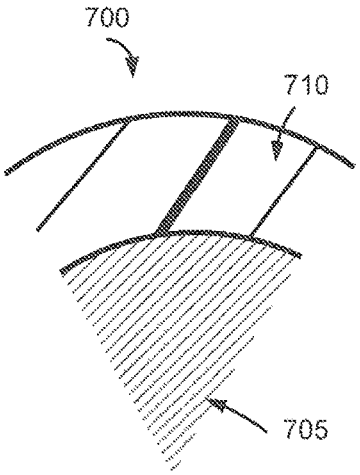
FIGS. 7A-7C are cross-sectional views of example insulation layers that may be formed around twisted pair conductors, according to illustrative embodiments of the disclosure.
Figure 7B:
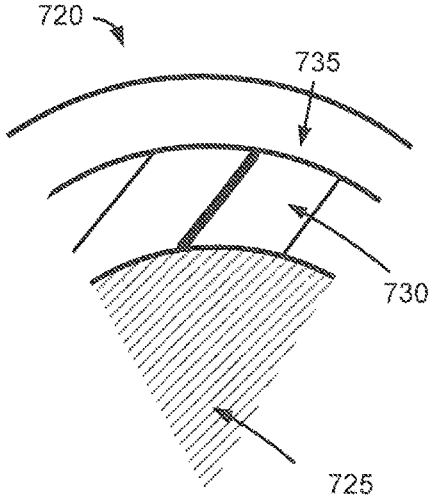
Figure 7C:
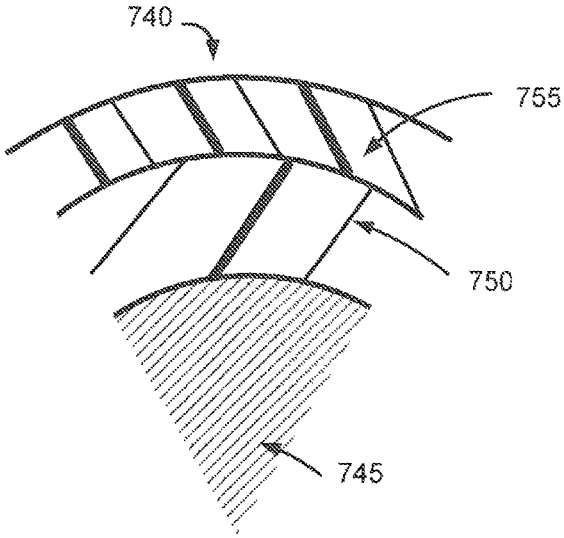

According to an aspect of the disclosure, one or more the twisted pairs incorporated into a cable, such as one of the cables illustrated in FIGS. 1-4, may incorporate one or more flame retardant polyolefin materials into the insulation of one or more twisted pair conductors. FIGS. 7A-7C are cross-sectional views of example insulation layers that may be formed around twisted pair conductors, according to illustrative embodiments of the disclosure. Turning first to FIG. 7A, a twisted pair conductor 700 electrically conductive material 705, and a single layer of insulation material 710 may be formed around the electrically conductive material 705. For example, a flame retardant polyolefin insulation layer, such as a flame retardant polypropylene or a flame retardant polyethylene, may be formed around the electrically conductive material 705. As another example, the insulation material 710 may include a flame retardant polyolefin that is mixed or blended with one or more other materials. Additionally, in certain embodiments, the insulation material 710 may be formed as a relatively solid insulation material 710. The insulation material 710 may have any suitable thickness, such as a thickness between approximately 0.004 inches and approximately 0.04 inches.

FIG. 7B illustrates another example twisted pair conductor 720 in which insulation material is formed around the electrically conductive material 725 of the conductor. The insulation material may include an inner layer 730 and an outer skin layer 735. At least one of the inner and/or outer layers 730, 735 may be formed from or include a flame retardant polyolefin material. The inner layer 730 may have any suitable thickness, such as a thickness between approximately 0.001 inches and approximately 0.004 inches. Additionally, the inner layer 730 may be formed as either a relatively solid layer or as a foamed layer. In the event that the inner layer 730 is foamed, any desired foaming level may be utilized, such as a foaming level between approximately 5.0 percent and approximately 40.0 percent. In certain embodiments, the outer layer 735 may be formed as a relatively thin layer, such as a layer having a thickness between approximately 0.001 inches and approximately 0.004 inches. For example, the outer layer 735 may be formed as a relatively thin foam skin layer. Additionally, in certain embodiments, the outer layer 735 may be formed from the same material or group of materials as the inner layer 730. In other embodiments, the outer layer 735 and inner layer 730 may be formed from different materials or groups of materials. For example, the inner layer 730 may be formed from a flame retardant polyolefin, and the outer layer 735 may be formed from one or more other polymeric materials.

FIG. 7C illustrates another example twisted pair conductor 740 in which insulation material is formed around the electrically conductive material 745 of the conductor. The insulation material may include an inner layer 750 and an outer layer 755, such as two extruded layers of material. In certain embodiments, each of the insulation layers 750, 755 may be formed as a relatively solid insulation layer. Additionally, at least one of the inner and/or outer layers 750, 755 may be formed from or include a flame retardant polyolefin material. Each of the layers 750, 755 may have any suitable thickness, such as a thickness between approximately 0.001 inches and approximately 0.01 inches. Additionally, in certain embodiments, the inner and outer layers 750, 755 may be formed from the same material or group of materials. For example, both layers 750, 755 may be formed from the same flame retardant polyolefin material. In other embodiments, the outer layer 755 and inner layer 750 may be formed from different materials or groups of materials. For example, the inner layer 750 may be formed from a first flame retardant polyolefin material (e.g., FRPP, FRPE, etc.), and the outer layer 755 may be formed from a second flame retardant polyolefin material. In the event that the first layer is formed from a FRPP material, the second layer may be formed from a different FRPP material, a FRPE material, or some other flame retardant polyolefin material. As another example, one of the layers 750, 755 may be formed from a flame retardant polyolefin material, and the other layer may be formed from one or more other materials.

The insulation constructions illustrated in FIGS. 7A-7C are provided by way of example only. Other suitable insulation constructions may be utilized as desired in association with twisted pair conductors. These constructions may incorporate a wide variety of suitable materials and/or combinations of materials. Additionally, various insulation constructions may include any number of layers of insulation material.

Figure 8A:
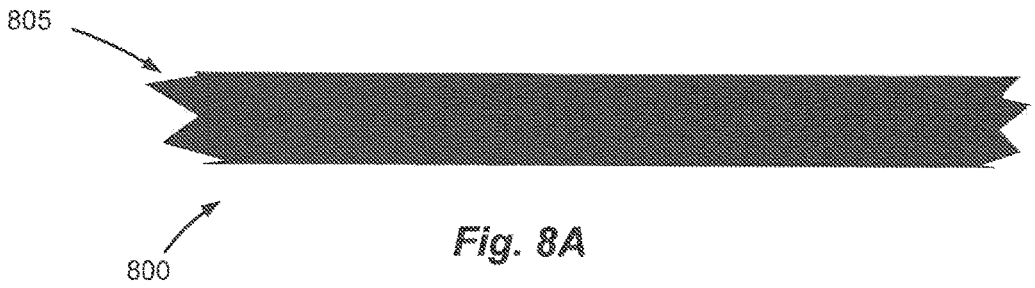
FIGS. 8A-8D are cross-sectional views of example structures that may be utilized to form shield layers or other shielding components, according to illustrative embodiments of the disclosure.
Figure 8B:
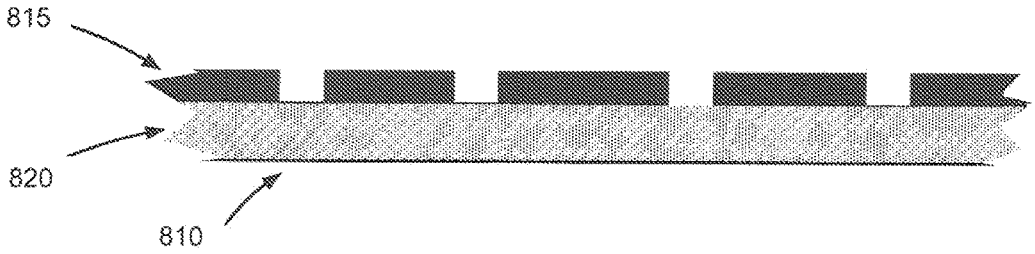

As set forth above, in certain embodiments, one or more shielding elements, such as one or more shield layers, may be incorporated into a cable. A shield layer may be formed with any number of suitable layers of material and/or layer configurations. FIGS. 8A-8D illustrate cross-sectional views of example tapes or flexible structures that may be utilized to form certain shield elements, according to illustrative embodiments of the disclosure. FIG. 8A illustrates an example flexible structure 800 that is formed with relatively continuous electrically conductive material 805. For example, the structure 800 may be formed as a foil or braided shield. FIG. 8B illustrates an example tape or flexible structure 810 that includes one or more patches of electrically conductive material 815 formed on a dielectric layer 820. Gaps or spaces may exist between adjacent patches along a longitudinal length of the structure 810.

Figure 8C:
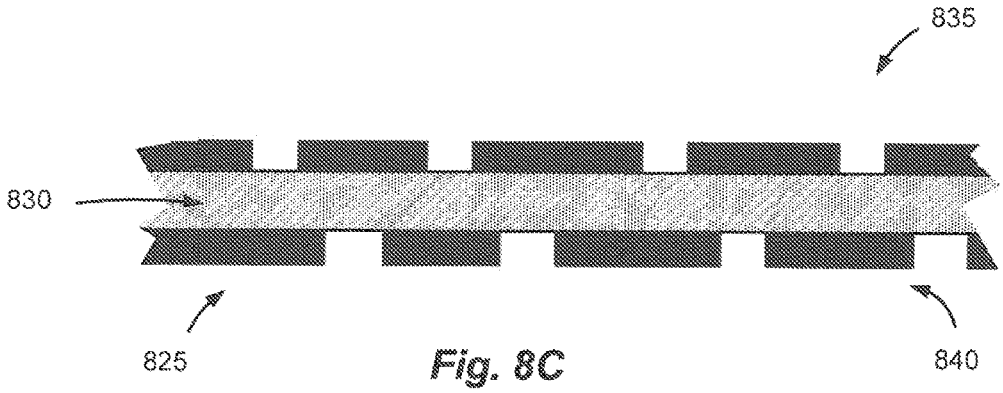
Figure 8D:
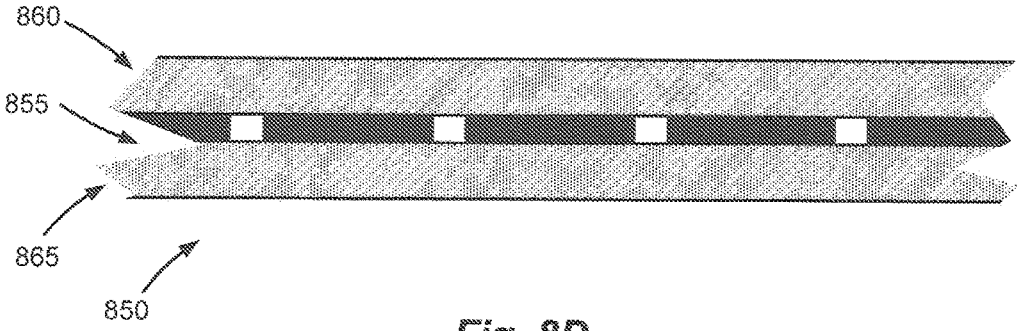

FIG. 8C illustrates an example tape or flexible structure 825 in which electrically conductive material is formed on opposite sides of a dielectric layer 830. As shown, first electrically conductive material 835 may be formed on a first surface or side of the dielectric layer 830, and the electrically conductive material 835 may include discontinuous patches of material with spaces or gaps formed between adjacent patches. Additional electrically conductive material 840 may be formed on an opposite surface or side of the dielectric layer 830. For example, patches of electrically conductive material may be formed on an opposite side of the dielectric layer 830 to cover gaps between adjacent patches formed on the first side. FIG. 8D illustrates another example tape or flexible structure 850 in which electrically conductive material 855 is sandwiched between two suitable dielectric layers 860, 865. A wide variety of other constructions may be utilized as desired to form a shield element. Indeed, any number of dielectric, electrically conductive, and/or other layers may be utilized. The constructions illustrated in FIGS. 8A-8D are provided by way of example only.

Figure 9A:
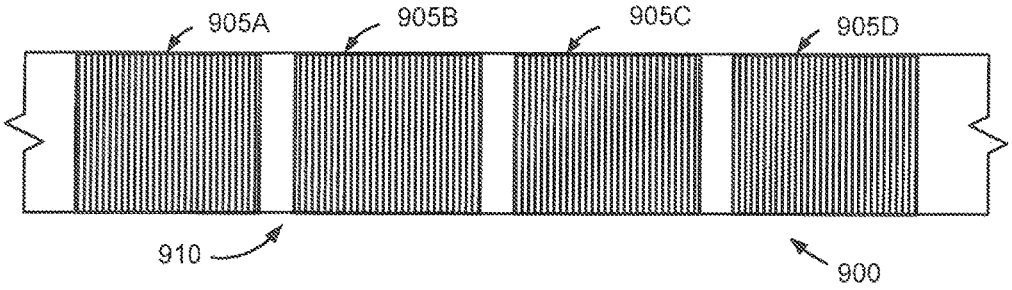
FIGS. 9A-9D are top level views of example structures that may be utilized to form shield layers or other shielding components, according to illustrative embodiments of the disclosure.

As set forth above, a wide variety of different electrically conductive patch configurations may be utilized in conjunction with shielding element, such as shield layers. FIGS. 9A-9D illustrate top level views of example tape or flexible structures that may be utilized to form certain shield elements. With reference to FIG. 9A, a top level view of a first example flexible structure 900 is illustrated. The structure 900 may include any number of rectangular patches of electrically conductive material, such as patches 905A-D formed on a dielectric material. As desired in various embodiments, the patches 905A-D may include any desired lengths, and any desired gap 910 or separation distance may be provided between adjacent patches. In certain embodiments, the patches may be formed in accordance with a repeating pattern having a definite step or period. As desired, additional patches may be formed on an opposing side of the dielectric material to cover the gaps 910. Additionally, in certain embodiments, each patch 905A-D may have a width that spans across the structure 900. In other embodiments, other patch widths may be utilized.

Figure 9B:
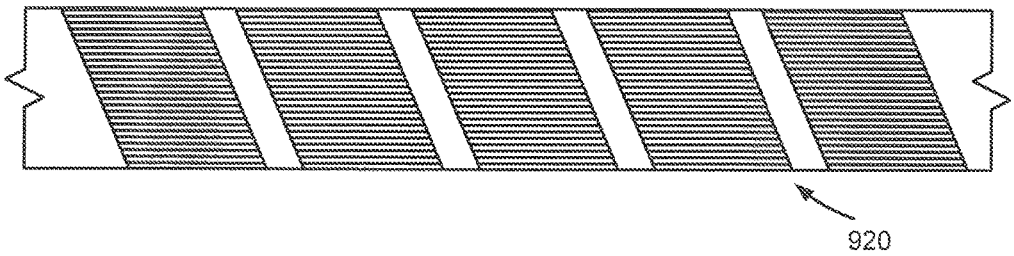

FIG. 9B illustrates a top level view of another example flexible structure 920 that may be utilized in the formation of a shield element. The flexible structure 920 may include any number of electrically conductive patches having the shape of a parallelogram. In other words, the patches may be formed at an angle within one or more areas of the structure 920 that correspond to one or more second portions of a separator. As shown, the patches may be formed at an acute angle with respect to the width dimension of the structure 920. In certain embodiments, the acute angle facilitates manufacturing and enhances patch-to-substrate adhesion. Additionally, the acute angle may also facilitate the covering of opposing isolating spaces or gaps. In certain embodiments, benefit may be achieved when the acute angle is about 45 degrees or less. In other embodiments, benefit is achieved when the acute angle is about 35 degrees or less, about 30 degrees or less, about 25 degrees or less, about 20 degrees or less, or about 15 degrees or less. In other embodiments, benefit is achieved when the acute angle is between about 12 and 40 degrees. In certain embodiments, the acute angle may be in a range between any two of the degree values provided in this paragraph.

Figure 9C:
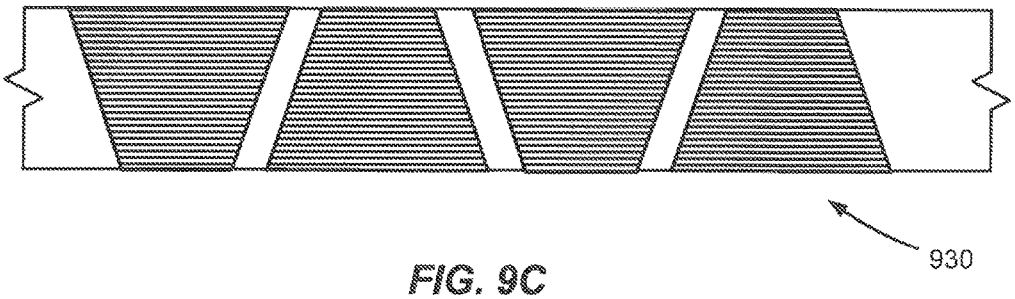
Figure 9D:
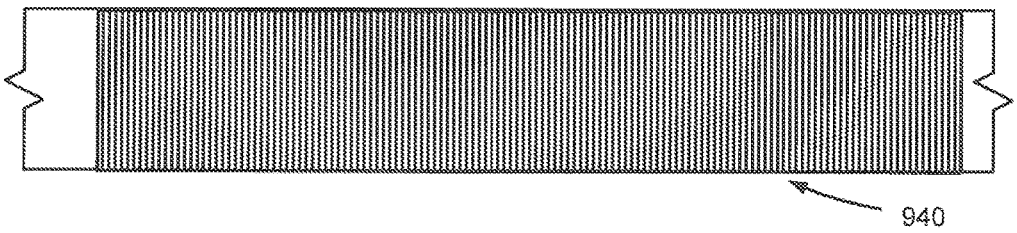

FIG. 9C illustrates a top level view of another example flexible structure 930 that may be utilized in the formation of a shielding element. The structure 930 may include any number of electrically conductive patches having a trapezoidal shape. In certain embodiments, the orientation of adjacent trapezoidal patches may alternate. Similar to the patch pattern illustrated in FIG. 9B, the trapezoidal patches may provide manufacturing and/or shielding benefits. FIG. 9D illustrates a top level view of another example flexible structure 940 that may be utilized in the formation of a shielding element. The structure 940 may include a relatively continuous patch of electrically conductive material. For example, the structure 940 may include a single patch of electrically conductive material formed on a dielectric substrate. In other embodiments, the structure 940 may include electrically conductive material without a dielectric substrate. A wide variety of other suitable patch configurations may be utilized as desired in various embodiments.

Figure 10:
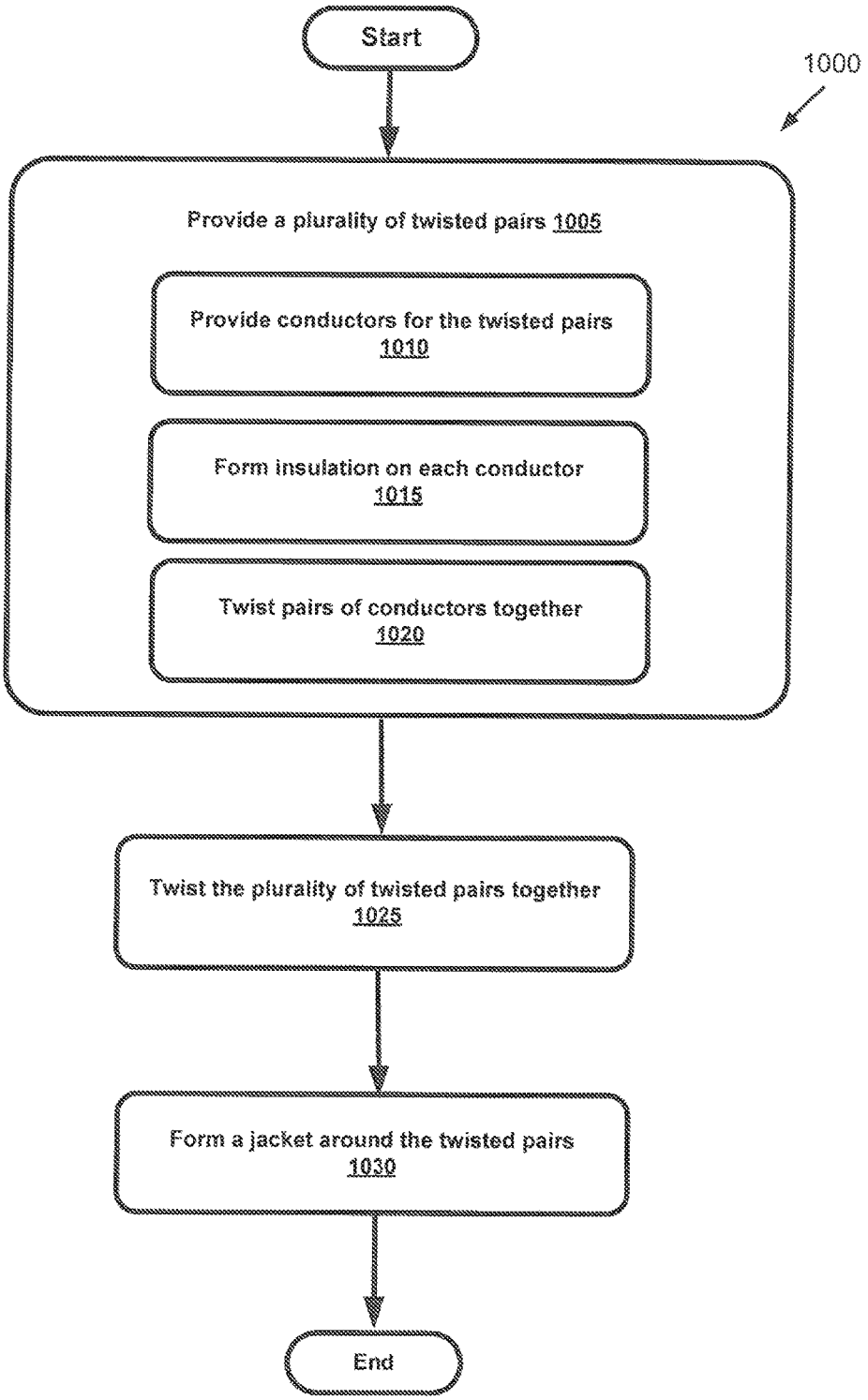
FIG. 10 is a flowchart of an example method for forming a twisted pair communication cable in accordance with various embodiments of the disclosure.

FIG. 10 is a flowchart of an example method 1000 for forming a twisted pair communication cable in accordance with various embodiments of the disclosure. The method 1000 may be utilized to form one or more of the cables illustrated in FIGS. 1-4, as well as a wide variety of other suitable cables. The method 1000 may begin at block 1005, in which a plurality of twisted pairs may be provided. Any number of twisted pairs may be provided, such as four twisted pairs. Additionally, a wide variety of suitable method and/or techniques may be utilized to provide a plurality of twisted pairs. For example, in certain embodiments, pre-formed twisted pairs may be provided.

In other embodiments, a plurality of twisted pairs may be formed either during cable construction (e.g., in an in-line cable construction process) or prior to cable construction (e.g., in a separate process in which the resulting twisted pairs are taken up on reels and subsequently provided to a cabling process that assembles and jackets a cable). At block 1010, a plurality of conductors may be provided for the twisted pairs. For example, input material may be drawn through one or more dies or otherwise processed in order to obtain conductor material having a desirable diameter or cross-sectional area. As another example, pre-drawn or pre-formed input material may be provided. As yet another example, a plurality of strands of conductive material may be twisted together in order to provide one or more conductors.

At block 1015, insulation may be formed around each of the conductors. For example, conductors may be fed from drawing devices, reels, or other devices, and one or more suitable extrusion devices may be utilized to extrude one or more layers of insulation material onto each conductor. According to an aspect of the disclosure, at least one layer of insulation material formed on one or more of the conductors may include a flame retardant polyolefin material. Additionally, as desired in certain embodiments, one or more foaming agents may be added to insulation material during extrusion. Once insulation has been formed around an outer circumference of the conductors, pairs of conductors may be twisted together in order to form the plurality of twisted pairs. Each twisted pair may include conductors twisted together with any suitable lay length, such as a lay length between approximately 0.30 inches and approximately 0.80 inches.

Once a plurality of twisted pair conductors have been provided, operations may continue at block 1025. At block 1025, the plurality of twisted pair conductors may be twisted together. For example, a plurality of twisted pairs may be provided to a twisting or twinning device that twists the plurality of pairs together. According to an aspect of the disclosure, the twist direction for the overall twist or bunch of the conductors may be opposite that of at least one of the twisted pairs. At block 1030, a jacket may be formed around the twisted pairs. For example, one or more suitable extrusion devices may be utilized to form a jacket around the twisted pairs. The method 1000 may end after block 1030.

As desired, the method 1000 may include more or less operations than those illustrated in FIG. 10. For example, one or more shield layers, twisted pair separators, a drain wire, and/or other components may be incorporated into a cable. Additionally, as desired, certain operations of the method 1000 may be formed in parallel or in a different order than that set forth in FIG. 10. Indeed, the method 1000 is provided by way of non-limiting example only.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A communications cable, comprising:

a plurality of twisted pairs of individually insulated conductors, each conductor insulated with a flame retardant polyolefin material and each twisted pair having a different respective twist lay between approximately 0.30 inches and approximately 0.80 inches; and a jacket formed around the plurality of twisted pairs, wherein the plurality of twisted pairs are twisted together in a first direction and the twisted pair having the shortest twist lay comprises conductors twisted together in a second direction opposite the first direction such that the pair's twist lay is loosened by between approximately 5 and approximately 25 percent.

2. The communications cable of claim 1, wherein each of the individually insulated conductors is insulated with the same flame retardant polyolefin material.

3. The communications cable of claim 1, wherein the flame retardant polyolefin material comprises flame retardant polypropylene.

4. The communications cable of claim 1, wherein the flame retardant polyolefin material comprises flame retardant polyethylene.

5. The communications cable of claim 1, wherein no separator is positioned between any two of the plurality of twisted pairs.

6. The communications cable of claim 1, further comprising:

a shield formed around at least one of the plurality of twisted pairs, the shield comprising electrically conductive material.

7. The communications cable of claim 6, wherein the shield comprises a plurality of patches of electrically conductive material that are electrically isolated from one another.

8. The communications cable of claim 1, wherein the cable satisfies electrical performance requirements of a Category 6 cabling standard.

9. A communications cable, comprising:

a jacket defining a cable core; and a plurality of pairs of conductors disposed within the cable core, the plurality of pairs being twisted together in a first direction, each of the pairs of conductors comprising two conductors individually insulated with a single layer of unfoamed material comprising one of (i) flame retardant polypropylene or (ii) flame retardant polyethylene, wherein at least one of the pairs of conductors is twisted together in a second direction opposite the first direction, and wherein the twisting of the plurality of pairs in the first direction loosens a twist lay of the at least one pair of conductors twisted together in the second direction such that a Category 6 propagation delay standard is satisfied.

10. The communications cable of claim 9, wherein each of the plurality of pairs has a different twist lay and the pair having the shortest twist lay is twisted in the second direction, and wherein twisting the plurality of pairs in the first direction loosens the twist lay of the pair having the shortest twist lay by between approximately 5 and approximately 25 percent.

11. The communications cable of claim 9, wherein the plurality of pairs are positioned in proximity to one another within the core without a separator being positioned between any two of the pairs.

12. The communications cable of claim 9, further comprising:

a shield formed around at least one of the plurality of pairs, the shield comprising electrically conductive material.

13. The communications cable of claim 12, wherein the shield comprises a plurality of patches of electrically conductive material that are electrically isolated from one another.

14. The communications cable of claim 9, wherein each of pairs of conductors is twisted together with a respective lay length between approximately 0.30 inches and approximately 0.80 inches.

15. A communications cable, comprising:

a jacket defining a cable core;

four twisted pairs of individually insulated conductors disposed in proximity to one another within the cable core, each pair comprising conductors covered with a respective single layer of unfoamed flame retardant polyolefin material, and each pair wound together with a different respective twist length between approximately 0.30 inches and 0.80 inches, wherein the four twisted pairs of conductors are wound together in a first direction, and wherein the twisted pair having the shortest twist length comprises conductors wound together in a second direction opposite the first direction such that the pair's twist length is loosened by between approximately 5 and approximately 25 percent.

16. The communications cable of claim 15, wherein the flame retardant polyolefin material comprises one of flame retardant polypropylene or flame retardant polyethylene.

17. The communications cable of claim 15, wherein no separator is positioned between any two of the twisted pairs.

18. The communications cable of claim 15, further comprising:

a shield formed around at least one of the twisted pairs, the shield comprising electrically conductive material.

19. The communications cable of claim 18, wherein the shield comprises a plurality of patches of electrically conductive material that are electrically isolated from one another.

20. The communications cable of claim 15, wherein the cable satisfies electrical performance requirements of a Category 6 cabling standard.

* * * * *